United States Patent [19]

Davies

[11] 4,168,549

[45] Sep. 25, 1979

[54] SEAT FOR USE WITH A BATHING DEVICE

[76] Inventor: John H. Davies, 2636 Templeton Dr., Vancouver, British Columbia, Canada, V5N 4W3

[21] Appl. No.: 892,067

[22] Filed: Mar. 31, 1978

Related U.S. Application Data

[63] Continuation-in-part of Ser. No. 768,923, Feb. 15, 1977, abandoned.

[51] Int. Cl.[2] ..... A47K 3/12

[52] U.S. Cl. ..... 4/185 S

[58] Field of Search .....4/185 A

[56] References Cited

U.S. PATENT DOCUMENTS

| | | | |
|---|---|---|---|
| 1,325,423 | 12/1919 | Stuart | 4/185 S |
| 2,237,076 | 4/1941 | Kenney et al. | 4/185 S |
| 2,648,849 | 8/1953 | Webb et al. | 4/185 L |
| 2,672,620 | 3/1954 | Gross | 4/185 L |
| 3,467,970 | 9/1969 | Ingemansson | 4/185 L |

*Primary Examiner*—William D. Martin, Jr.
*Attorney, Agent, or Firm*—Townsend and Townsend

[57] ABSTRACT

The device comprises a track made up of two spaced rails adapted to extend across a bath. The spacing of the rails is fixed. There are stops on the underside of the track to contact the upper, inner sides of the bath to hold the track in place in the bath. A seat has wheels to engage the rails to enable the seat to reciprocate across the bath. There is a brake operable to hold the seat in a predetermined position on the track. The device is easily assembled and dismantled, easily used and simple in structure.

3 Claims, 3 Drawing Figures

SEAT FOR USE WITH A BATHING DEVICE

CROSS REFERENCES TO RELATED APPLICATIONS

This application is a continuation in part of my application Ser. No. 768,923, filed Feb. 15, 1977 now abandoned.

FIELD OF INVENTION

This invention relates to a bathing device to enable amputees and people with other physical handicaps to bath themselves.

DESCRIPTION OF PRIOR ART

There are a number of devices to assist amputees and invalids into a bath. Often amputees and invalids are unable to move themselves in and out of a bath with ease but require assistance. However, prior devices have proved to have a number of disadvantages. For example, they are too heavy, not easily managed and not easily installed and some are elaborate in structure.

SUMMARY OF INVENTION

The present invention seeks to provide a device that is extremely simple in structure, that can be adaptable to all dimensions of known domestic baths and can easily be positioned, for example by the person wishing to use the device.

Accordingly, in a first aspect, the present invention is a bathing device comprising spaced bars defining a track adapted to rest on the longitudinal edges of a bath and to extend at a first end of the track beyond one longitudinal edge of the bath; stops spaced from the ends of the track to contact the inner, upper edges of the sides of the bath to locate the track in the bath; at least one of said stops being adjustable to accommodate varying bath widths; a seat having wheels to engage the track to enable reciprocation of the seat along the track from a loading position where a person gets on the seat, outside the bath, to a washing position between the longitudinal edges of the bath; stops at at least one longitudinal edge of the track to maintain the wheels on the track; a brake formed on the seat so that the seat may me maintained selectively in a predetermined position; the brake comprising a flange extending downwardly from the underside of the seat at at least one edge of the seat to overlap with the exterior of one angle bar of the track; a threaded hole in the flange; a threaded member to engage the hole and extend through the hole to contact the outer edge of the angle bar when required to brake the seat in a predetermined position; a housing formed at each corner of the first end of the track; a housing formed at each corner of the first end of the track; a leg adapted to be received in each housing; means to secure each leg in its respective housing; feet adapted to be located in said legs, each foot being provided with a projection to attach to said legs; and means to vary the relative positions of the projections and the leg to permit variation in the height of the track.

In a preferred embodiment of the above device the adjustable stop has a threaded stud at each end extending outwardly of the track. Aligned downwardly extending brackets are formed on each rail and there is a slot formed in each bracket to engage each threaded stud. A threaded member can be tightened on each stud to secure the stud at a predetermined position in a slot to control the position of the stop.

It is also desirable that the device be adjustable for different widths of bath and for different heights of baths.

According to a further aspect the present invention is a bathing device comprising spaced members defining a track and adapted to extend at a first end of the track beyond a longitudinal edge of a bath, spaced members extending downwardly at said first end and across each other to form legs; a pivotal joint between the legs where they cross; means extending between said legs to hold them in a predetermined, open position when the device is in use but to enable easy folding and storing of the device; a support adapted to be engaged on a wall; engagement means formed on the support; corresponding engagement means formed on a second end of the spaced members defining the track whereby, by engagement of the support engagement means and the corresponding engagement means on the spaced members, the track can be secured in a position across a bath; a seat having runners on its base to engage around the track to enable reciprocation of the seat along the track from a loading position where a person gets on the seat, outside the bath, to a washing position between the longitudinal edges of the bath; feet adapted to be located in said legs, each foot being provided with a projection to attach to said legs and means to vary the relative positions of the projections and the legs to permit variation in the height of the track.

BRIEF DESCRIPTION OF DRAWINGS

The invention is illustrated, merely by way of example, in the accompanying drawings in which.

DESCRIPTION OF PREFERRED EMBODIMENTS

Figure 1:
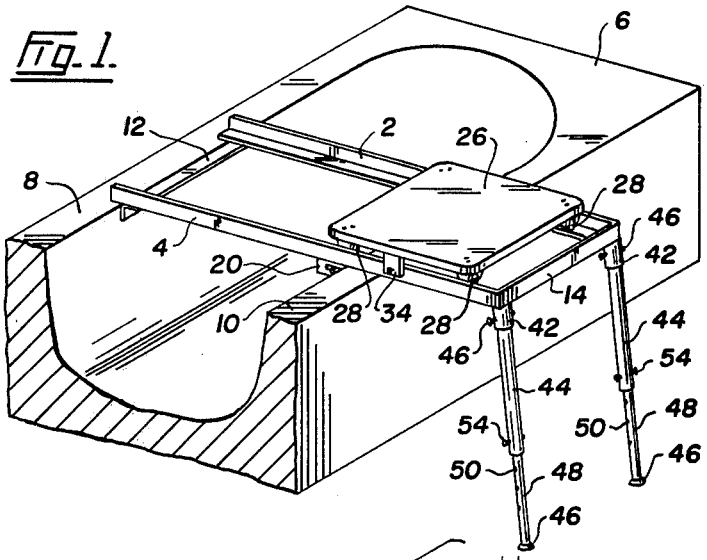
FIG. 1 is a general view of a preferred embodiment of the invention in position in a bath, shown partly in section.
Figure 2:
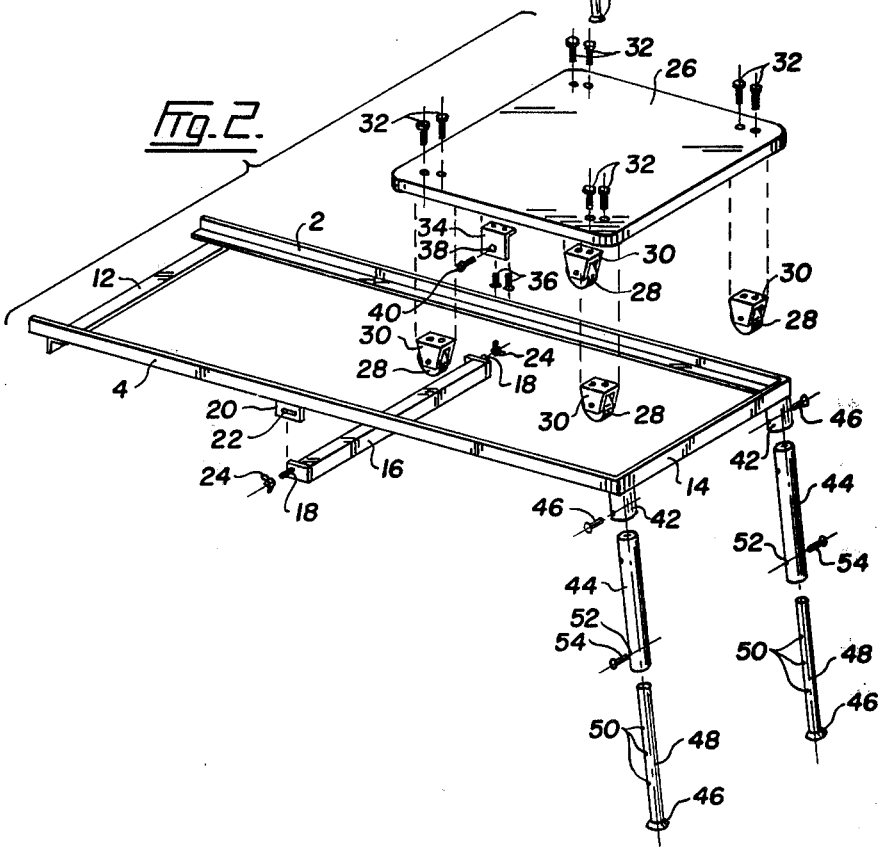
FIG. 2 is an exploded view of the bathing device shown in FIG. 1.

FIGS. 1 and 2 show a bathing device comprising a track made up of spaced rails 2 and 4. The rails are of a length sufficient to extend across a bath 6. The rails are positioned to rest on the longitudinal edges 8 and 10 of the bath 6 and, in the embodiment illustrated in FIG. 1, extend beyond the longitudinal edge 10. There are means to fix the spacing of the rails in the form of a cross member 12 at one end and a cross member 14 at the other end. Cross member 12 also functions as a stop on the underside of the rails 2 and 4 to contact the upper, inner side of the bath 6 to hold the track in place in the bath 6. As illustrated most clearly in FIG. 2 an adjustable stop 16 is also provided to contact the upper inner side of the bath 6 adjacent its edge 10 to hold the track in place.

Stop 16 is rendered adjustable by the provision of threaded studs 18 positioned at each end of stop 16. Studs 18 extend outwardly of the rails 2 and 4. There are aligned, downwardly extending brackets 20 on rails 2 and 4-only one of which, that on rail 4,-is shown. Each bracket 20 has a slot 22 formed in it to engage a threaded stud 18. There is a nut 24 to engage the threaded stud 18 after it has passed through a slot 22. The effect of this arrangement is to permit movement of the stop 16 along the rails 2 and 4 by the studs 18 sliding in the slots 22. When a required position of the stop 16 is found nuts 24 are tightened on the studs 18, against the brackets 20 to locate the stop 16.

Figure 3:
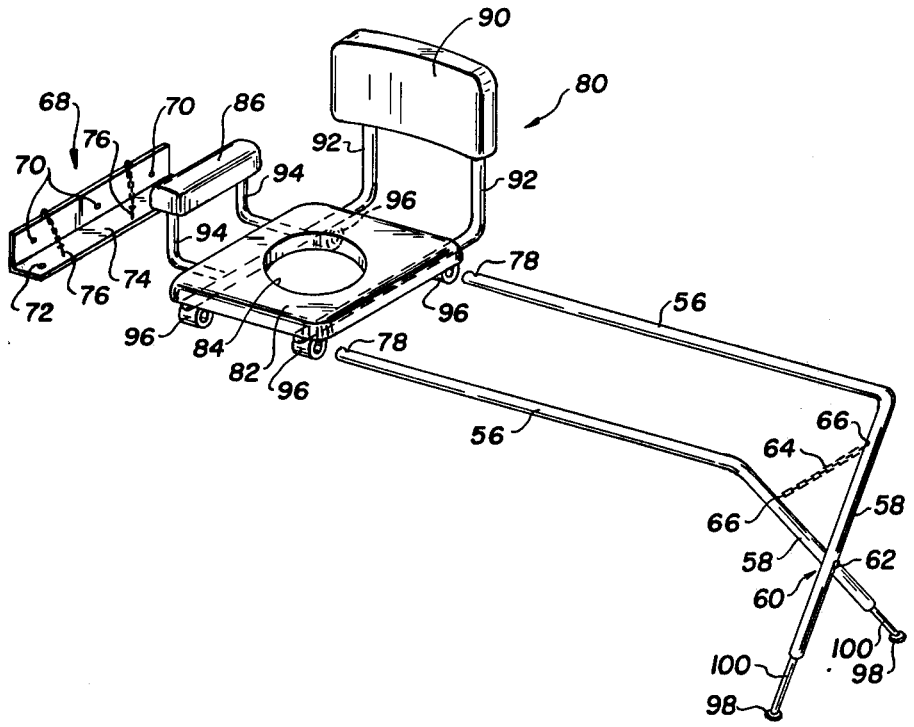
FIG. 3 illustrates a further embodiment of the invention.

There is a seat 26 having wheels 28 near each corner. Wheels 28 are mounted in simple brackets 30 which are located by screws 32 extending through the seat 26. This arrangement permits reciprocation of the seat 26 along the rails 2 and 4. The seat 26 can reciprocate from a position outside the bath-for example as shown in FIG. 1-where a person may sit on the seat to a position-as shown in FIG. 3-between the edges 8 and 10 of the bath 6 where a person may shower or bath. In the illustrated embodiment the tracks 2 and 4 are made of angle and the upstanding edges of the angle act as stops to maintain the wheels 28 on the tracks 2 and 4.

A brake is formed on the seat 26. The brake comprises a downwardly extending bracket 34 screwed to the seat 26 by screws 35. Bracket 34 extends outside the rail 4 and overlaps with the upstanding portion of rail 4. There is a threaded hole 38 formed in the bracket 34 and a bolt 40 is threaded to engage and extend through hole 38 to abut the upstanding portion of rail 4. Once the seat 26 is moved to a desired position along the rails 2 and 4 the bolt 40 can be screwed through the hole 38 to abut the exterior of the track 4 to prevent further movement of the seat. Normally only one such brake is required. However, is desired, brakes may be provided to contact each of the rails 2 and 4. To facilitate gripping it is desirable that bolt 40 have a handle welded to it.

The embodiment of FIGS. 1 and 2 is provided with telescopic legs. It is highly desirable that the legs be telescopic to accommodate the quite large differences in the heights of baths. In the embodiment of FIGS. 1 and 2 the device is provided with housings 42 adjacent each of its outer corners. A leg portion 44 engages the interior of each socket 42 and may be secured in place by pins 46. Typically pins 46 extend through pairs of aligned holes, one pair in the housing 42 and another pair in the legs 44. At the other end of the legs 44 there are telescoping foot members comprising feet 46 preferably made of a resilient, non-slip material. Feet 46 are each provided with a projection 48 provided with a plurality of holes 50. Holes 50 are in aligned pairs. There is a pair of aligned holes 52 adjacent each of the lower ends of the legs 44. Pin 54 can extend through the aligned holes 52 in the leg 44 and through a required pair of holes 50 in each of the legs 48 to set the height of the device to correspond with the height of the bath.

The device illustrated in FIGS. 1 and 2 is simple to install. Generally speaking, where the device is privately owned it is simply necessary to adjust the position of the stop 16 and the height of the legs 44 for the bath or baths in one particular house. Further adjustment is not then necessary. It should be noted that the device can be moved easily and, in particular, the seat can be lifted from the track and the legs 44 disengaged from the housings 42 to facilitate storage of the device.

It is desirable that all parts of the device that contact the bath 6 be provided with a substantial coating, for example of a plastic such as polyvinyl chloride, to prevent the scratching of the bath. The devices illustrated in the drawings may desirably be made of aluminum or plastic. The seat 26 can, for example, be molded from plastic or made from marine plywood. If necessary the seat 26 can be formed with a control hole, like a toilet seat, to facilitate washing, as shown in FIG. 3.

The device illustrated in FIG. 3 has been designed specifically to produce a simple device, easily folded and stored away, easy to place in the useful position and particularly simple in structure. The device of FIG. 3 comprises spaced members 56 defining a track and adapted to extend at a first end of the track beyond the longitudinal edge of a bath (which is not shown in FIG. 3 but is positioned precisely as in FIG. 1). The members 56 extending downwardly at the first end to form legs 58. Legs 58 cross each other at a pivotal joint 60. Pivotal joint 60 may simply comprise a bolt 62 inserted through aligned holes in the legs 58 and a nut maintaining the bolt in position. There are means extending between said legs 58 to hold them in a predetermined open position. In FIG. 3 the means comprises a simple chain 64 anchored on each leg at 66.

There is a support 68 provided with holes 70 so that it may be screwed to a wall in a bathroom. There are holes 72 formed on portion 74 of the support 68. Pins 76 are located on the support 68. Holes 78 in the spaced members 56 may be aligned with holes 72 in the support 68 and the pins 76 then inserted through aligned pairs of holes 72 and 78 providing a positive location for the device.

There is a seat 80 having a base 82 with a central hole 84, an arm rest 86 and a back 90. The back 90 and base 82 are mounted on tubular members 92. The arm rest 86 is mounted on tubular members 94. There are runners 96 attached to the tubular members 92 and these runners 96 are tubular in section, in the illustrated embodiment, so that they may engage around the members 92. It is desirable that the runners have a low friction synthetic, for example polytetrafluoroethylene.

The device illustrated in FIG. 3 has a number of advantages. For example is is extremely simple in construction. The tubular runners 96, particularly when lined with a low friction synthetic resin, are mobile on the members 56 so that the seat 80 can be moved along the members 56 easily. However, once at rest a push on the side is required so that the device may be considered to be self braking.

In the device of FIG. 3 it has been found desirable to make the members 56, 92 and 94 and runners 96 stainless steel.

It is desirable to provide feet 98 in the ends of the legs 58. Feet 98 are provided with projections 100 to attach to the legs 58. As in FIGS. 1 and 2 it is desirable that the projections 100 be telescopic within the tubular, spaced members 58, thus permitting variation in the height of the device.

The illustrated devices generally reduce the work required of assistants normally required to assist amputees, invalids and other disabled people to enter a bath.

I claim:

1. A bathing device comprising:

spaced angle bars defining a track adapted to rest on the longitudinal edges of a bath and to extend at a first end of the track beyond one longitudinal edge of the bath;

stops spaced from the ends of the track to contact the inner, upper edges of the sides of the bath to locate the track in the bath;

at least one of said stops being adjustable to accommodate varying bath widths;

a seat having wheels to engage the track to enable reciprocation of the seat along the track from a loading position where a person gets on the seat, outside the bath, to a washing position between the longitudinal edges of the bath;

stops at at least one longitudinal edge of the track to maintain the wheels on the track;

a brake formed on the seat so that the seat may be maintained selectively in a predetermined position;

the brake comprising a flange extending downwardly from the underside of the seat at at least one edge of the seat to overlap with the exterior of one angle bar of the track;

a threaded hole in the flange;

a threaded member to engage the hole and extend through the hole to contact the outer edge of the angle bar when required to brake the seat in a predetermined position;

a housing formed at each corner of the first end of the track;

a leg adapted to be received in each housing;

means to secure each leg in its respective housing; feet adapted to be located in said legs, each foot being provided with a projection to attach to said legs; and means to vary the relative positions of the projections and the leg to permit variation in the height of the track.

2. A device as claimed in claim 1 in which the adjustable stop has a threaded stud at each end extending outwardly of the track;

aligned downwardly extending brackets formed on each rail;

a slot formed in each bracket to engage each threaded stud; and a threaded member to tighten on each stud to secure the studs at a predetermined position in a slot to control the position of the stop.

3. A device as claimed in claim 1 in which the legs have feet of a flexible, non-slip material.

* * * * *